US009162368B2

(12) United States Patent
Kameda et al.

(10) Patent No.: US 9,162,368 B2
(45) Date of Patent: Oct. 20, 2015

(54) ELECTRIC STAPLER

(75) Inventors: Futoshi Kameda, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 414 days.

(21) Appl. No.: 13/604,815

(22) Filed: Sep. 6, 2012

(65) Prior Publication Data

US 2013/0098962 A1 Apr. 25, 2013

(30) Foreign Application Priority Data

Oct. 20, 2011 (JP) ..... 2011-230711

(51) Int. Cl.

| | |
|---|---|
| ***B27F 7/19*** | (2006.01) |
| ***B27F 7/38*** | (2006.01) |
| ***B27F 7/36*** | (2006.01) |
| ***B27F 7/17*** | (2006.01) |
| ***B25C 5/15*** | (2006.01) |

(52) U.S. Cl.

CPC ..... *B27F 7/19* (2013.01)

(58) Field of Classification Search

CPC ..... B27F 7/38; B27F 7/19; B27F 7/36; B27F 7/17; B25C 5/0228; B25C 5/0207; B25C 5/15

USPC ..... 227/2, 111, 155, 131, 120

See application file for complete search history.

(56) References Cited

U.S. PATENT DOCUMENTS

| | | | | |
|---|---|---|---|---|
| 5,460,314 | A * | 10/1995 | Udagawa | 227/155 |
| 5,660,314 | A * | 8/1997 | Magnusson et al. | 227/2 |
| 6,050,471 | A * | 4/2000 | Yagi | 227/119 |
| 6,705,504 | B1 | 3/2004 | Kanai et al. | |
| 7,661,569 | B2 | 2/2010 | Matsukawa | |
| 2008/0029569 | A1 | 2/2008 | Sugihara | |
| 2009/0152318 | A1 | 6/2009 | Matsukawa | |

FOREIGN PATENT DOCUMENTS

| | | |
|---|---|---|
| CN | 1042507 | 3/1999 |
| CN | A-101282827 | 10/2008 |
| EH | A2-0838315 | 4/1998 |
| EP | 0 605 888 A1 | 7/1994 |
| EP | 1 932 638 A1 | 6/2008 |
| JP | UM-A-S63-74286 | 5/1988 |
| JP | UM-A-H6-15977 | 3/1994 |
| JP | A-H7-266253 | 10/1995 |
| JP | 2561157 | 1/1998 |
| JP | A-2004-181560 | 7/2004 |
| JP | A-2004-358977 | 12/2004 |
| JP | A-2005-22166 | 1/2005 |
| JP | 3620351 | 2/2005 |
| JP | 2005-335021 | 12/2005 |
| JP | 4103700 | 6/2008 |
| JP | A-2009-142937 | 7/2009 |
| WO | WO 94-27788 | 12/1994 |

* cited by examiner

*Primary Examiner* — Michelle Lopez

(74) *Attorney, Agent, or Firm* — Drinker Biddle & Reath LLP

(57) ABSTRACT

An electric stapler (10) is provided with a driver mechanism (11) and a clincher mechanism (40). A clamp part (13) is slidably accommodated in a main body (12) of the driver mechanism (11). The clamp part (13) clamps sheets of paper in cooperation with the clincher mechanism (40). The clamp part (13) is urged toward the sheets by a biasing mechanism (14). The biasing mechanism (14) is out of operation of urging the clamp part (13) when the clamp part (13) is in a home position which is the most remote from the clincher mechanism (40).

8 Claims, 12 Drawing Sheets

ELECTRIC STAPLER

BACKGROUND OF THE INVENTION

1. Field of the Invention

The present invention relates to an electric stapler.

2. Related Art

Conventionally, an electric stapler is known which is placed at a sheet conveying path inside a copier or a printer for binding a plurality of sheets of paper that have been copied or printed.

In one of the conventional electric staplers, a straight-shaped staple is formed into a U-shape by a forming plate and then the staple formed into the U-shape is driven into sheets by a driver member (see, for example, Patent Document 1: JP-B2-3620351).

In one of the conventional electric staplers, a clincher mechanism is provided at a position opposing to a driver mechanism in which a forming plate or a driver member is accommodated and a staple is driven into sheets in a state where the sheets are clamped between the driver mechanism and the clincher mechanism. Here, legs of the staple driven and penetrating through the sheets are bent along a clincher groove of the clincher mechanism, thereby binding the sheets (see, for example, Patent Document 2: JP-A-2005-335021).

In one of the conventional electric staplers, when sheets are clamped between a driver mechanism and a clincher mechanism, a mechanism (spring, etc.) for adjusting a difference in a thickness of the sheets is provided. For example, Patent Document 3 (JP-Y2-2561157) discloses a configuration in which a paper thickness adjustment spring is provided to a driver link.

In one of the conventional electric staplers, a mechanism for detecting a presence or absence of staples is provided. For example, Patent Document 4 (JP-B2-4103700) discloses a configuration in which a detection sensor for detecting the presence or absence of staples and outputting a detected signal is provided at a frame that supports a magazine. In the configuration, a flag member which is disposed to face the detection sensor when the electric stapler is in the inactive condition and activates to allow the detection sensor to detect the presence or absence of staples is provided at the magazine. A detection member which is disposed to enter into the connected staples loading space of a cartridge and activated by the connected staples loaded in the cartridge is provided on the cartridge. A cooperation member is provided between the detection member and the flag member to operate the detection member in cooperation with the flag member in a state where the cartridge is mounted on the magazine.

According to the structure of Patent Document 3, since the paper thickness adjustment spring is provided to the driver link, a load of the spring is always applied even in a state where the sheets are not clamped (a stand-by state where the staple is not driven). Accordingly, there is a problem that a magazine urged by the spring is swung and thus slanted or a guide groove is worn.

Further, if the flag member is provided at the magazine as disclosed in Patent Document 4, there is a problem that the flag member is deviated from a detecting area of the sensor due to the slant of the magazine and thus the detection of the presence or absence of staples does not work properly.

SUMMARY OF THE INVENTION

One or more embodiments of the invention provide an electric stapler, in which a clamp part for clamping sheets of paper is urged to adjust a paper thickness, that can reduce a slant of the clamp part by not always subjecting the clamp part to an urging force.

BRIEF DESCRIPTION OF THE DRAWINGS

FIG. 11(*a*) is a view showing the mechanism as seen obliquely from the upper side, in a state where the connected staples are present. FIG. 11(*b*) is a side view of the mechanism.

FIG. 12(*a*) is a view showing the mechanism as seen obliquely from the upper side, in a state where the connected staples are absent. FIG. 12(*b*) is a side view of the mechanism.

DETAILED DESCRIPTION OF THE EMBODIMENTS

Figure 1:
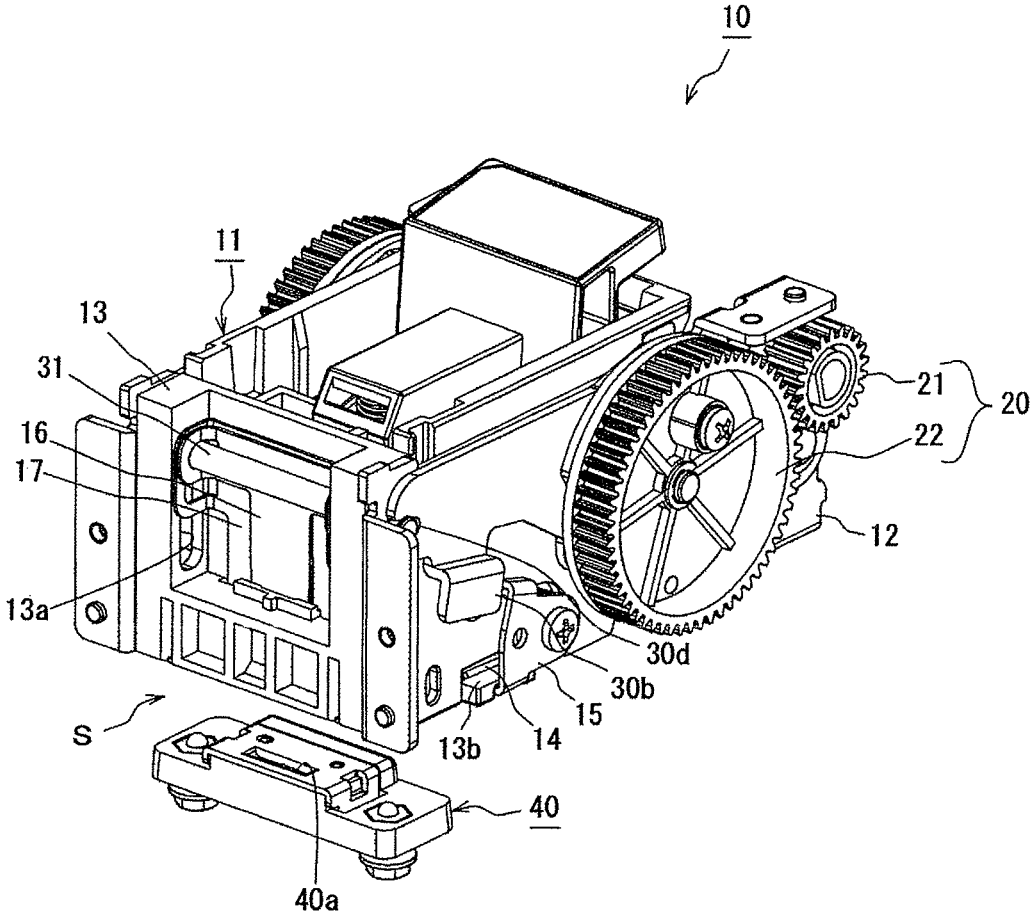
FIG. 1 is an external view of an electric stapler, showing a state where a clamp part is in a home position.
Figure 2:
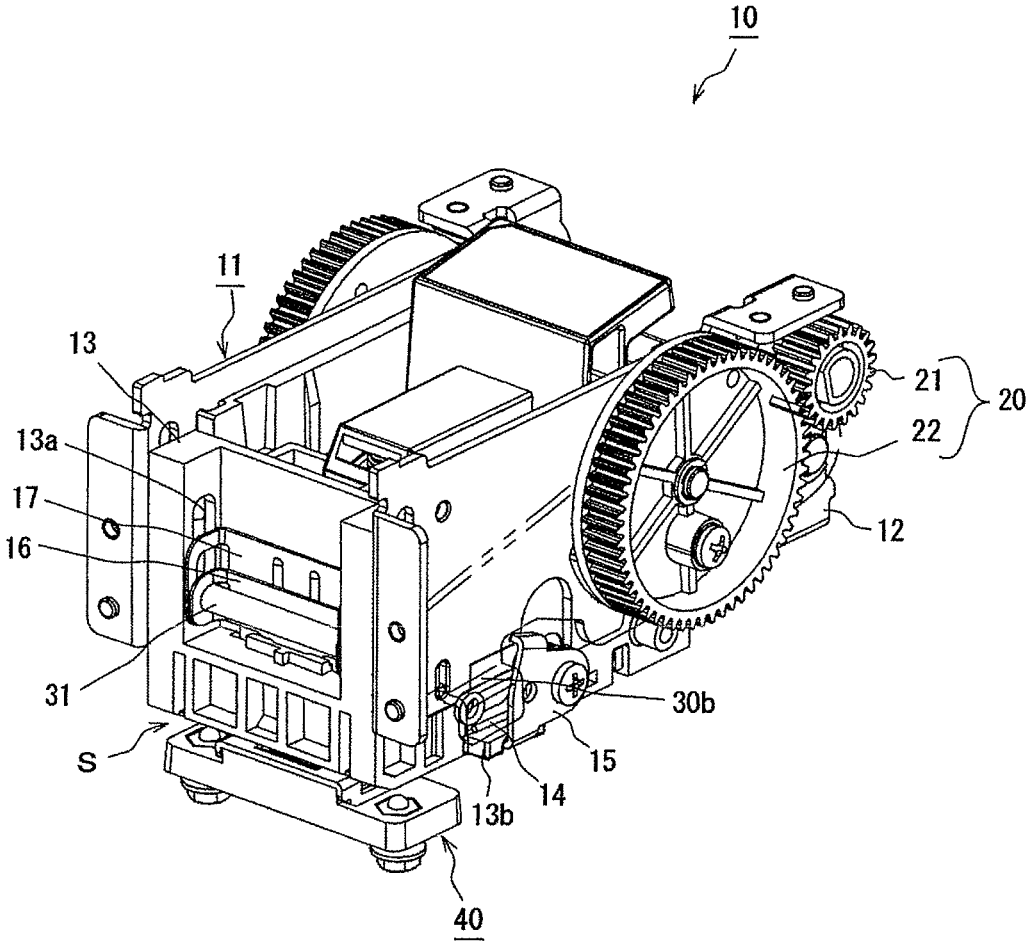
FIG. 2 is an external view of the electric stapler, showing a state where the clamp part is lowered.

The description will be given hereinbelow on the basis of embodiments with reference to the drawings. Further, the embodiments are not intended to limit the invention but to merely serve as examples thereof, and all features or combinations thereof described in the embodiments are not always essential to the invention.

As shown in FIGS. 1 to 4, an electric stapler 10 according to an embodiment is placed at a sheet conveying path inside a copier or a printer and intended to bind a plurality of sheets of paper that have been copied or printed. The electric stapler 10 includes a driver mechanism 11 and a clincher mechanism 40. The driver mechanism 11 separates the connected staples "A" into individual staples and forms each of the individual staples into a substantially U shape and then drives the staple into the sheets. The clincher mechanism 40 is provided to face the driver mechanism 11 and adapted to bend legs of the staple driven and penetrating through the sheets along a back side of the sheets.

When driving the staple, first, the sheets as a driving target of the staple are inserted into a gap S between the driver mechanism 11 and the clincher mechanism 40 and then (the clamp part 13 of) the driver mechanism 11 and the clincher mechanism 40 clamps the sheets and then the staple is driven into the sheets.

Although not particularly shown, the connected staples "A" are obtained by placing a plurality of straight-shaped staples in multiple parallel and connecting adjacent staples by an adhesive, etc. A refill product is obtained by stacking and binding the connected staples "A" and stored in a cartridge. The cartridge storing the refill cartridge is detachably housed inside the clamp part 13 (which will be described later).

A feed mechanism for feeding the staples stacked in the cartridge to an ejection part 11*a* is provided in the cartridge. The connected staples "A" stored inside the clamp part 13 are biased by a spring, etc. and thus a leading staple is sequentially supplied to the ejection part 11*a* and then formed into a U-shape by a forming plate 17. And then, the staple formed into the U-shape is ejected toward the sheets by the driver member 16.

A clincher groove 40*a* of the clincher mechanism 40 is formed at a position opposing to the ejection part 11*a*. The legs of the staple ejected toward the sheets by the driver member 16 pass through the sheets and then enter the clincher groove 40*a*. And then, the legs are bent along the clincher groove 40*a* to clinch the sheets.

Herein, the driver mechanism includes a main body 12, the clamp part 13 slidably housed in the main body 12, a clamp spring 14 for biasing the clamp part 13 toward the sheets, a gear mechanism 20 driven by a motor, a forming plate 17 actuated by the gear mechanism 20 to form the staple into the U shape, a driver member 16 actuated by the gear mechanism 20 to drive the staple, a link member 30 swung by a cam 22*b* which is included in the gear mechanism 20 to drive the forming plate 17 and the driver member 16, a sensor 35 provided to the main body 12 and, a detecting piece 32 for detecting the presence or absence of the connected staples "A".

Hereinafter, the configuration of each part will be described.

(Main Body 12)

As shown in FIGS. 1 to 4, the main body 12 is a frame which is provided relative to the clincher mechanism 40 and fixed in a state where a gap S for inserting the sheets is formed between the clincher mechanism 40 and the main body 12. A guide hole 12*a* extending vertically along the driving direction of the staple is formed at a side portion of the main body 12. The guide hole 12*a* is intended for guiding a shaft 31 which is supported by the link member 30 (which will be described later).

(Clamp Part 13)

As shown in FIGS. 1 to 4, the clamp part 13 is a box-shaped member which is slidably housed in the main body 12. The clamp part 13 moves toward or away from the clincher mechanism 40 to clamp the sheets in cooperation with the clincher mechanism 40.

A siding hole 13*a* extending vertically along the driving direction of the staple is formed at a side portion of the clamp part 13. The sliding hole 13*a* is disposed at a position overlapping with the guide hole 12*a* of the main body 12 as seen from the side and set slightly shorter than the guide hole 12*a* in the vertical direction. The shaft 31 (which will be described later) passes through the sliding hole 13*a*.

(Clamp Spring 14)

The clamp spring 14 is provided as a biasing mechanism for biasing the clamp part 13 toward the sheets. Specifically, the clamp spring 14 is a torsion coil spring fixed to the clamp part 13.

As shown in FIGS. 1 to 4, the clamp spring 14 is held by a clamp spring plate 15. A lower side of the clamp spring plate 15 is fixed to a spring support part 13*b* of the clamp part 13 and an upper side thereof is fixed to the clamp part 13.

The clamp spring plate 15 is intended to prevent the clamp spring 14 from expanding more than a certain level and the clamp spring 14 is in a state where the biasing force thereof is suppressed by the clamp spring plate 15.

An upper end 14*a* of the clamp spring 14 is exposed to engage with the link member 30 when the link member 30 (which will be described later) is lowered to a predetermined position.

(Gear Mechanism 20)

The gear mechanism 20 is driven by a motor (not shown) as an example of a drive source which is provided in a copier, a printer or a main body of an electric stapler, etc. As shown in FIGS. 1 to 4, the gear mechanism 20 includes a first gear 21 which is rotated by a driving force from the motor and a second gear 22 which is rotated by a driving force transmitted from the first gear 21.

Figure 3:
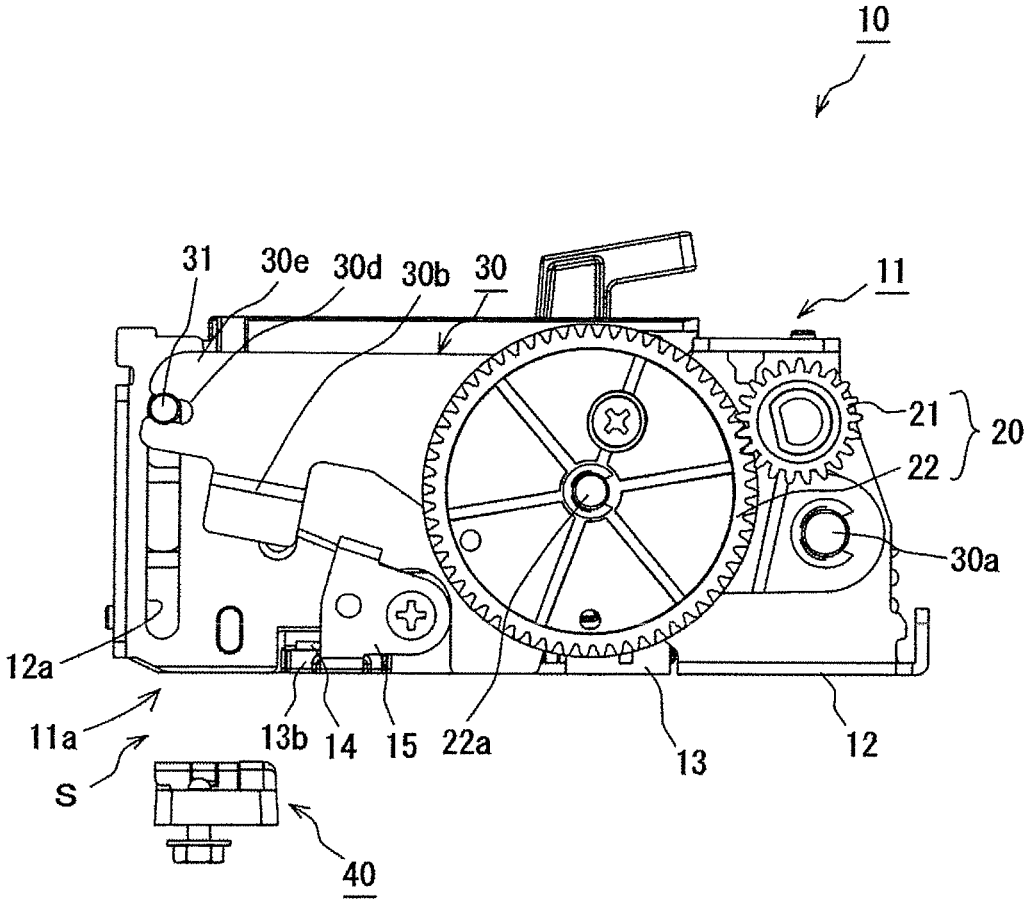
FIG. 3 is a side view of the electric stapler.
Figure 4:
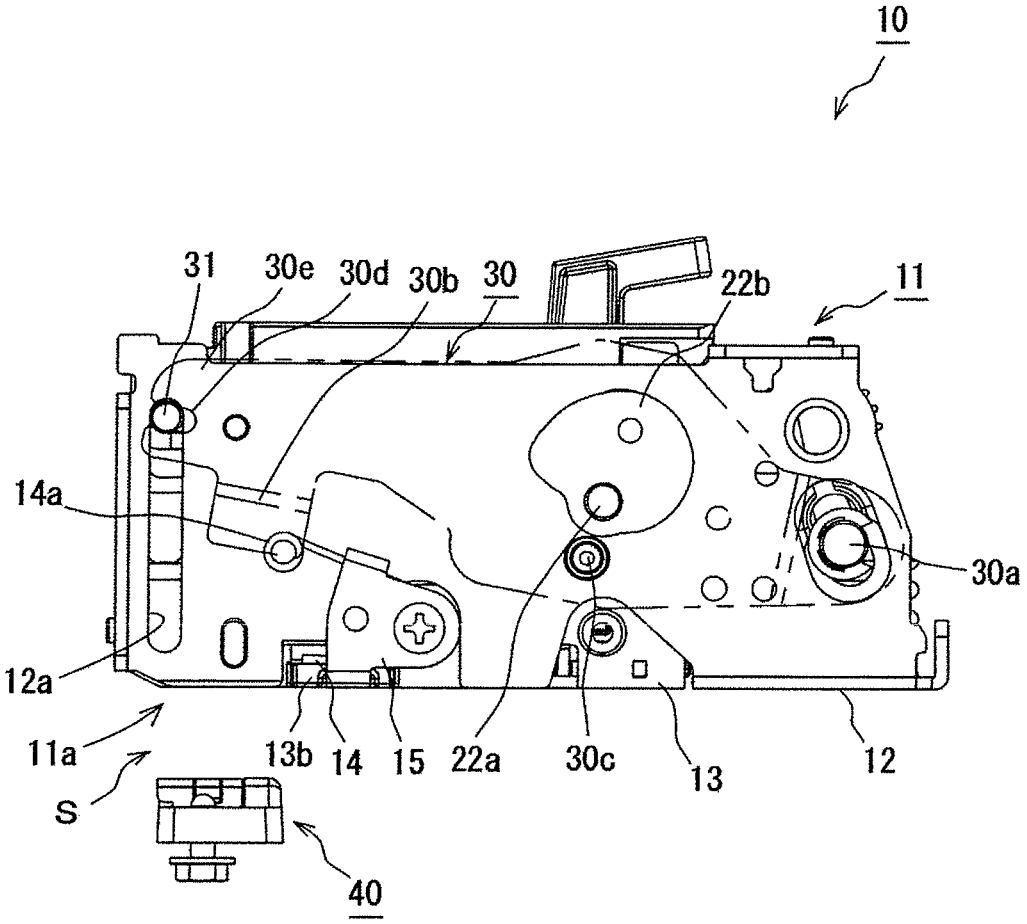
FIG. 4 is an explanatory view showing a mechanism of the electric stapler.

As shown in FIGS. 3 and 4, a cam 22*b* is disposed on a back side of the second gear 22 and rotates around the same shaft 22*a*. The cam 22*b* is a disc cam in which a distance from a circumference of the disc to the shaft 22*a* is not constant.

The motor for driving the gear mechanism 20 is controlled by a control device (not shown) which is provided in a copier, a printer or a main body of an electric stapler, etc. Further, the same gear mechanism 20 is respectively provided at both sides of the main body 12 and the cams 22*b* of each of two gear mechanisms 20 are overlapped in the same shape as seen from the side. By this configuration, the two gear mechanisms 20 are formed to take exactly the same behavior as each other when the motor is driven.

(Link Member 30)

The link member 30 is a member which is swung by the above-described cam 22*b*. As shown in FIGS. 3 and 4, the link member 30 is swingably fixed to the main body 12 by a link shaft 30*a* which is provided on the opposite side of the ejection part 11*a*. The link member 30 is swung about the link shaft 30*a*, so that a leading end 30*e* of the link member 30 on the side of the ejection part 11*a* is swung up and down. The link member 30 is constantly biased upward (in a direction away from the clincher mechanism 40) by a spring (not shown). The link member 30 is provided respectively corresponding to the above-described two gear mechanisms 20.

A shaft holding part 30*d* for holding the shaft 31 is formed at the leading end 30*e* of the link member 30.

The shaft 31 extends in the horizontal direction in a state where both ends of the shaft 31 are held on the shaft holding parts 30*d* of the link members 30 on both sides. The shaft 31 passes through the guide hole 12*a* of the above-described main body 12 and the sliding hole 13*a* of the clamp part 13.

The shaft 31 slides vertically along the guide hole 12*a* of the main body 12 when the link member 30 is swung. As the shaft 31 is slid upward to a predetermined position along the guide hole 12*a*, the shaft 31 is engaged with an upper edge of the sliding hole 13*a* of the clamp part 13 to lift the clamp part 13. In this way, the shaft 31 forms the clamp engagement part which is engaged with the clamp part 13.

Further, the shaft 31 extends through holes formed on upper ends of the forming plate 17 and the driver member 16, thereby holding the forming plate 17 and the driver member 16. Therefore, as the shaft 31 is moved up and down, the forming plate 17 and the driver member 16 are moved up and down in conjunction with the shaft.

Further, an inverted L-shaped biasing engagement part 30*b* projecting outward is provided at the bottom near the leading end 30*e* of the link member 30. The biasing engagement part 30*b* is provided at a position where the biasing engagement part is engageable with the above-described clamp spring 14. A downwardly facing surface of the biasing engagement part is brought into contact with the upper end 14*a* of the clamp spring 14 to receive a biasing force of the clamp spring 14 when the link member 30 is swung down to a predetermined position. In this way, the biasing force is applied to the clamp spring 14.

Further, as shown in FIGS. 4 to 9, a shaft-shaped cam engagement part 30*c* projecting laterally is formed at an intermediate portion of the link member 30. The cam engagement part 30*c* is engaged with a lower peripheral edge of the cam 22*b* and pressed down to a predetermined position along the peripheral edge of the cam 22*b* when the cam 22*b* is rotated and thus, the link member 30 is moved downward against the biasing force of the spring.

(Sensor 35)

Figure 10:
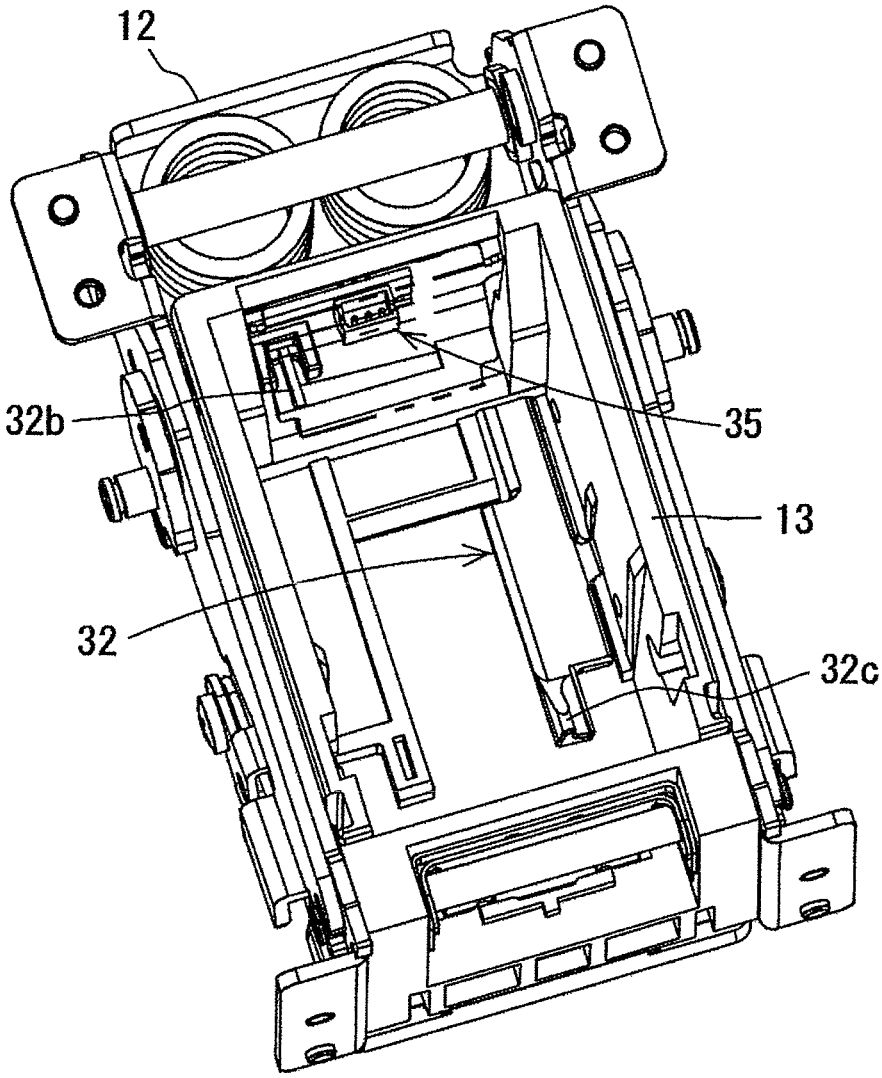
FIG. 10 is a view showing a portion of a driver mechanism as seen obliquely from the upper side, explaining a mechanism for detecting the presence or absence of connected staples.

As shown in FIG. 10, the sensor 35 is a photo sensor which is provided inside of the main body 12 and senses a state of the detecting piece 32 and outputs a signal in accordance with the presence or absence of the connected staples "A".

As shown in FIG. 10, the sensor 35 is a groove-type photo sensor and senses whether an object is present at a groove portion 35*b* of a U-shaped detection part 35*a* or not.

The sensor 35 is connected to a control device which is provided in a copier, a printer or a main body of an electric stapler, etc. The sensor checks the presence or absence of the connected staples "A" in accordance with an instruction from the control device and transmits a check result to the control device.

Although the sensor 35 and the control device are connected to each other via a cable (not shown), there is no need to use a special cable that takes into account the movement of the sensor 35 since the sensor 35 is attached to the main body 12 which is fixedly provided and a positional relationship between the sensor 35 and the control device is fixed (If the sensor 35 is provided at a movable part such as the clamp part 13, it is necessary to take into account the movement of the sensor 35 and thus a relatively expensive flexible cable is required. However, there is no need to use a special cable in the embodiments.).

(Detecting Piece 32)

Figure 11A:
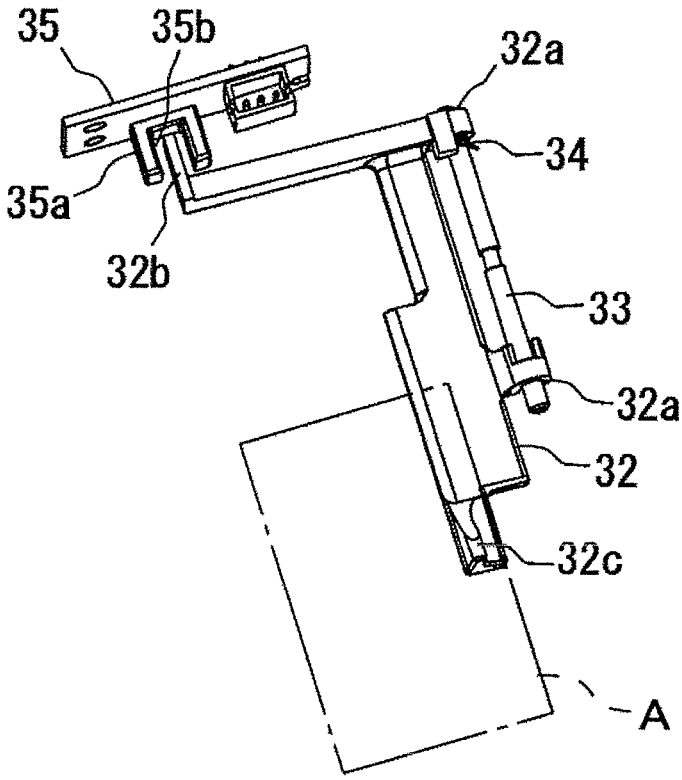
FIGS. 11(*a*) and 11(*b*) are views showing a mechanism for detecting a presence or absence of the connected staples.
Figure 11B:
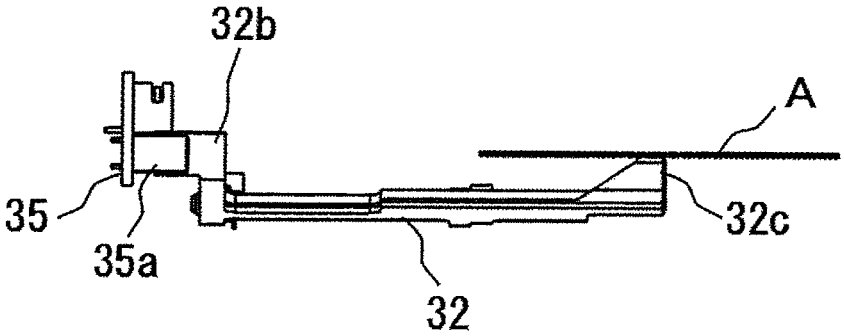
Figure 12A:
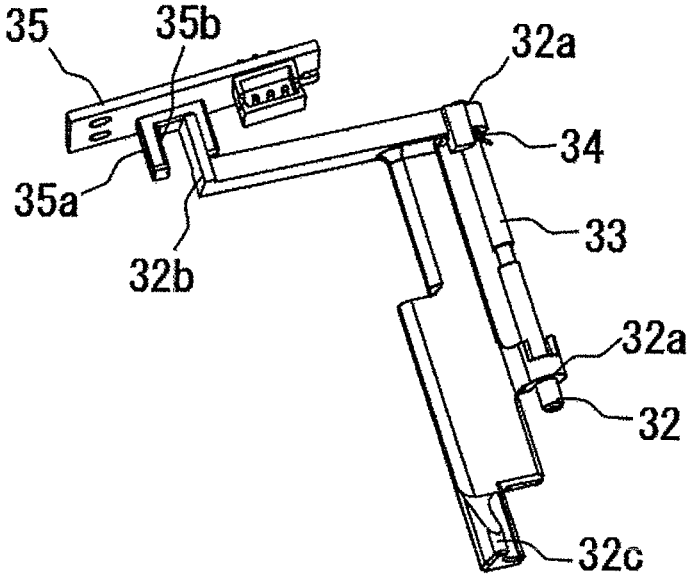
FIGS. 12(*a*) and 12(*b*) are views showing a mechanism for detecting the presence or absence of the connected staples.
Figure 12B:
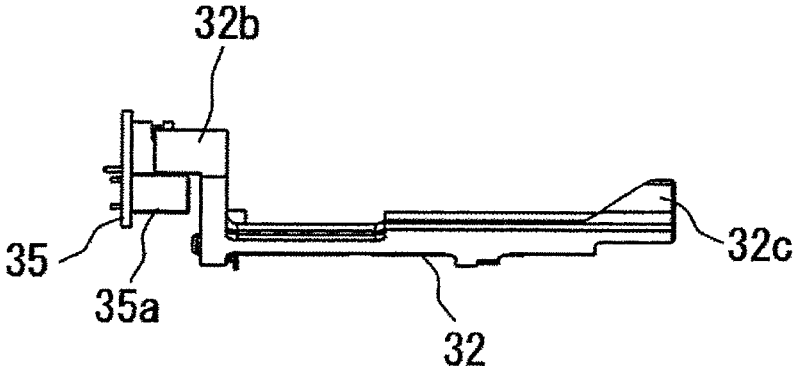

The detecting piece 32 is intended for detecting the presence or absence of the connected staples "A". As shown in FIGS. 10 to 12, the detecting piece 32 is a member which is pivotably fixed to the clamp part 13. A shaft hole 32*a* is formed at an end of the detecting piece 32 and the detecting piece 32 is fixed to the clamp part via a support shaft 33 which passes through the shaft hole 32*a*.

Further, the detecting piece 32 includes a protruding portion 32*b* protruding toward an opposite end of the shaft hole 32*a*. Since the protruding portion 32*b* extends in a direction perpendicular to the shaft hole 32*a*, the protruding portion 32*b* is swung up and down as the detecting piece 32 is pivoted around the shaft hole 32*a*. The protruding portion 32*b* is arranged so that the protruding portion 32*b* is swung up and down and thus a leading end thereof appears or disappears relative to the groove portion 35*b* of the above-described sensor 35.

Further, the detecting piece 32 is provided with a contact portion 32*c* in substantially parallel to the protruding portion 32*b*. The contact portion 32*c* is arranged to engage with the connected staples "A" which is stored inside the clamp part 13.

The detecting piece 32 is biased by a coil spring 34 disposed in the vicinity of the shaft hole 32*a* in a direction where the contact portion 32 is engaged with the connected staples "A".

Therefore, when the connected staples "A" are present in the clamp part 13 as shown in FIG. 11, the contact portion 32*c* is pressed against and engaged with the connected staples "A" by the biasing force of the coil spring 34. In this state, since the protruding portion 32*b* is located inside of the groove portion 35*b* of the sensor 35 and the detecting piece 32 is located on the optical path of the sensor 35, the sensor 35 can detect the presence of the connected staples "A".

Meanwhile, when the connected staples "A" are not present in the clamp part 13 as shown in FIG. 12, the contact portion 32*c* is not engaged with the connected staples "A" and thus the detecting piece 32 is pivoted by the biasing force of the coil spring 34. In this state, since the protruding portion 32*b* is located outside of the groove portion 35*b* of the sensor 35 and the detecting piece 32 is not located on the optical path of the sensor 35, the sensor 35 can detect the absence of the connected staples "A".

In this way, the sensor 35 detects the presence or absence of staples and outputs the detection result to the control device which is provided in a copier or a printer, etc. The control device receives a signal in accordance with the presence or absence of the staples and can perform processing such as displaying a message for promoting the replacement of the staples, for example.

(Operation of the Electric Stapler 10)

Next, an operation of the above-described electric stapler 10 will be described with reference to FIGS. 5 to 9.

Figure 5:
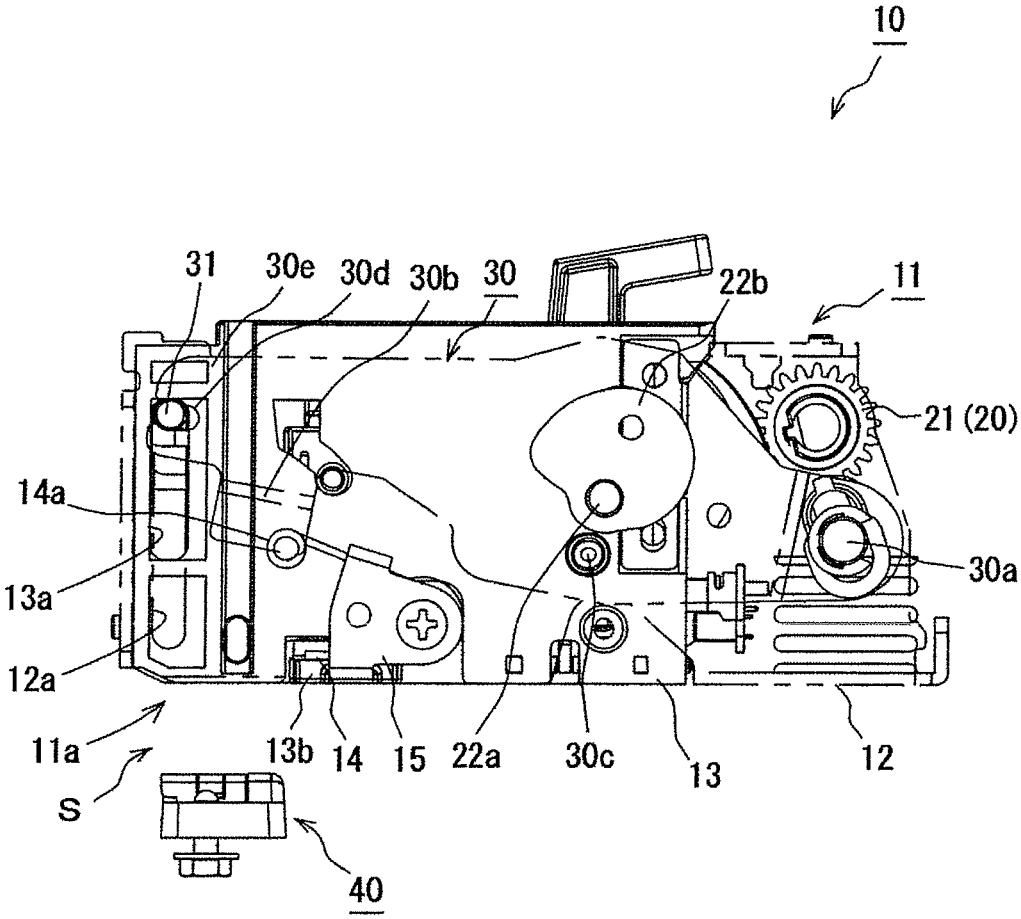
FIG. 5 is an explanatory view showing an operation of the electric stapler, showing a state where the clamp part is in the home position.

FIG. 5 is a view showing a state where the clamp part 13 is in the home position. Herein, the home position refers to a state where the clamp part 13 is in an uppermost position most apart from the clincher mechanism 40 and also a stand-by state before the sheets are clamped between the clamp part 13 and the clincher mechanism 40. In the home position, the sheets are supplied to a gap S between the clamp part 13 and the clincher mechanism 40 by a paper feeding device (not shown) which is provided in a copier or a printer, etc. And then, the motor is driven to activate the electric stapler 10 and thus the staple is driven into the sheets.

In the home position, a distance from a peripheral edge of the lower end of the cam 22*b* to the shaft 22*a* of the cam 22*b* is the shortest. That is, the link member 30 is minimally pressed down by the cam 22*b*. Thereby, the link member 30 is located at the uppermost position.

At this time, the shaft 31 supported by the shaft holding part 30*d* of the link member 30 is also located at the uppermost position and is engaged with an upper edge of the sliding hole 13*a* of the clamp part 13. Thereby, the clamp part 13 is lifted upward to the uppermost position (home position) by the shaft 31.

Further, the biasing engagement part 30*b* of the link member 30 is not engaged with the clamp spring 14 since the biasing engagement part 30*b* is located at a position higher than the upper end 14*a* of the clamp spring 14. Accordingly, the biasing force of the clamp spring 14 is not applied to the clamp part 13.

Figure 6:
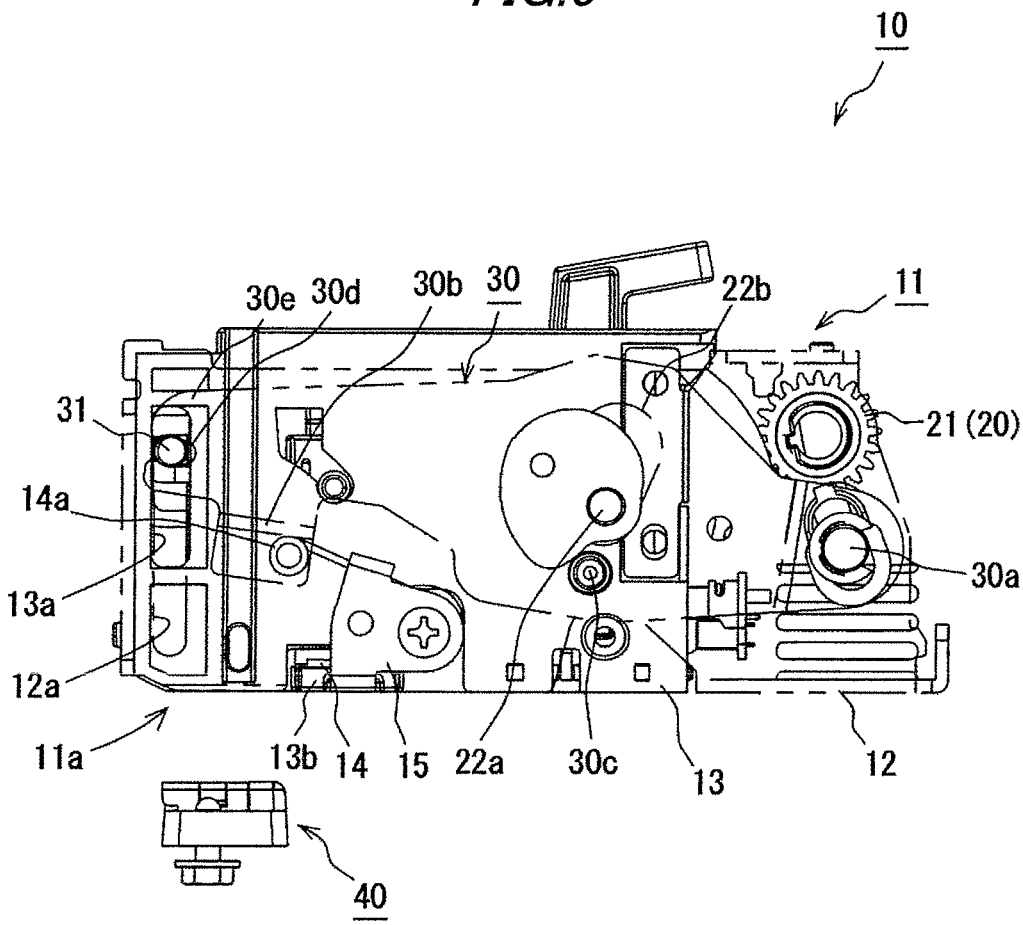
FIG. 6 is an explanatory view showing an operation of the electric stapler, o showing a state immediately after the clamp part begins to descend.

FIG. 6 a view showing a state immediately after the clamp part 13 begins to descend. That is, FIG. 6 is a view showing a state where the motor is driven to activate the gear mechanism 20 and thus the cam 22*b* is rotated so that the cam engagement part 30*c* is slightly pressed down by the cam 22*b*. As the cam engagement part 30*c* is pressed down, the link member 30 is swung around the link shaft 30*a* and thus the leading end thereof moves downward.

At this time, the shaft 31 supported by the shaft holding part 30*d* of the link member 30 is also slightly moved downward. Thereby, the driver member 16 and the forming plate 17 which are held by the shaft 31 are also moved downward (in the driving direction). Further, as the shaft 31 lifting the clamp part 13 is slightly moved downward, the engagement of the shaft 31 and the upper edge of the sliding hole 13*a* of the clamp part 13 is released and thus the clamp part 13 is slidable downward by the movement amount of the shaft 31.

According to an embodiment, although the clamp part 13 is not moved from the home position due to a sliding resistance between the clamp part 13 and the main body 12, the clamp part 13 is slidable downward. That is, the clamp part 13 is capable of moving in a direction approaching toward the clincher mechanism 40.

Further, the biasing engagement part 30*b* of the link member 30 is lowered to a position in which the biasing engagement part 30*b* is brought into contact with the upper end 14*a* of the clamp spring 14.

Figure 7:
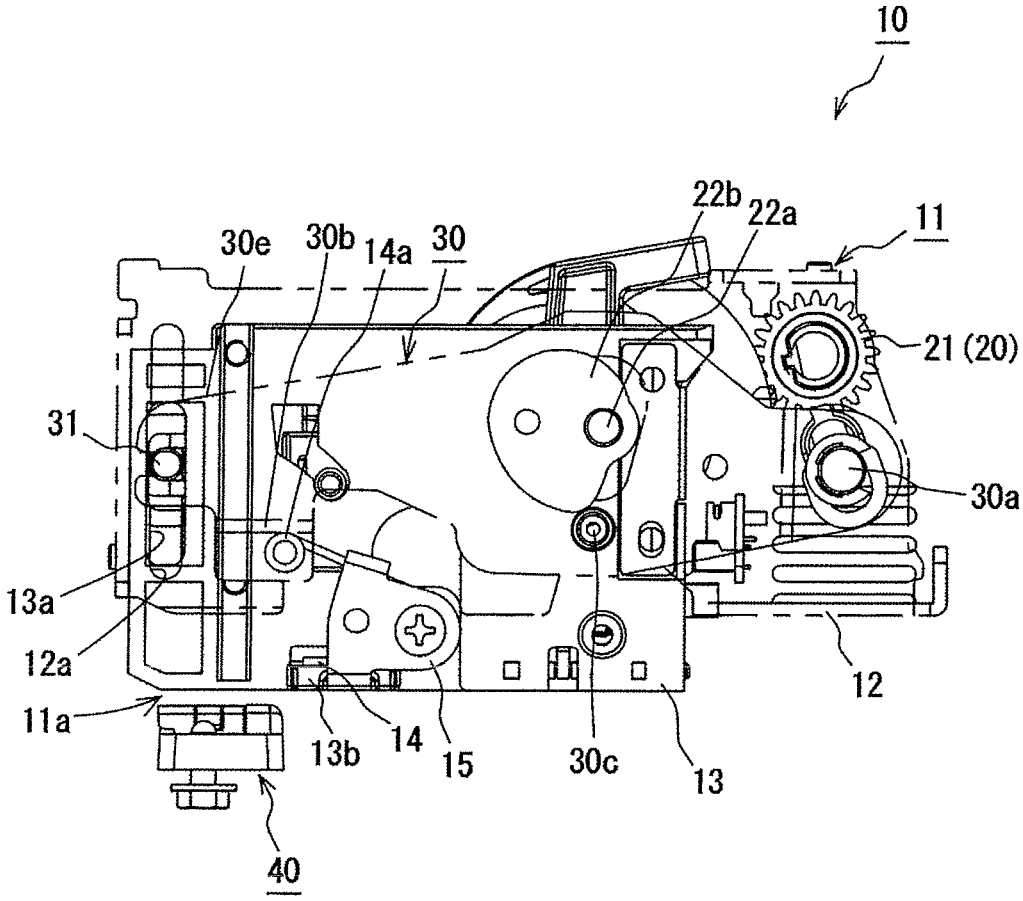
FIG. 7 is an explanatory view showing an operation of the electric stapler, showing a state where the clamp part is lowered to the middle.

When the motor is further driven from the position shown in FIG. 6 and thus the gear mechanism 20 is activated, a state as shown in FIG. 7 is obtained. In this state, the shaft 31 supported by the shaft holding part 30*d* of the link member 30 is further moved downward and also the driver member 16 and the forming plate 17 which are o held by the shaft 31 are further moved downward (in the driving direction). Further, as the shaft 31 is further moved downward, the shaft 31 is moved downward along the sliding hole 13*a*. Accordingly, in the relationship of the shaft 31 and the sliding hole 13*a*, the clamp part 13 is further slidable downward.

At this time, since the biasing engagement part 30*b* of the link member 30 is engaged with the upper end 14*a* of the clamp spring 14, the biasing engagement part 30*b* of the link member 30 presses the clamp spring 14 downward. Then, a downward load by the link member 30 is transmitted to the clamp part 13 via the clamp spring 14 to move the clamp part 13 downward. That is, the clamp part 13 is moved in a direction approaching toward the clincher mechanism 40.

Figure 8:
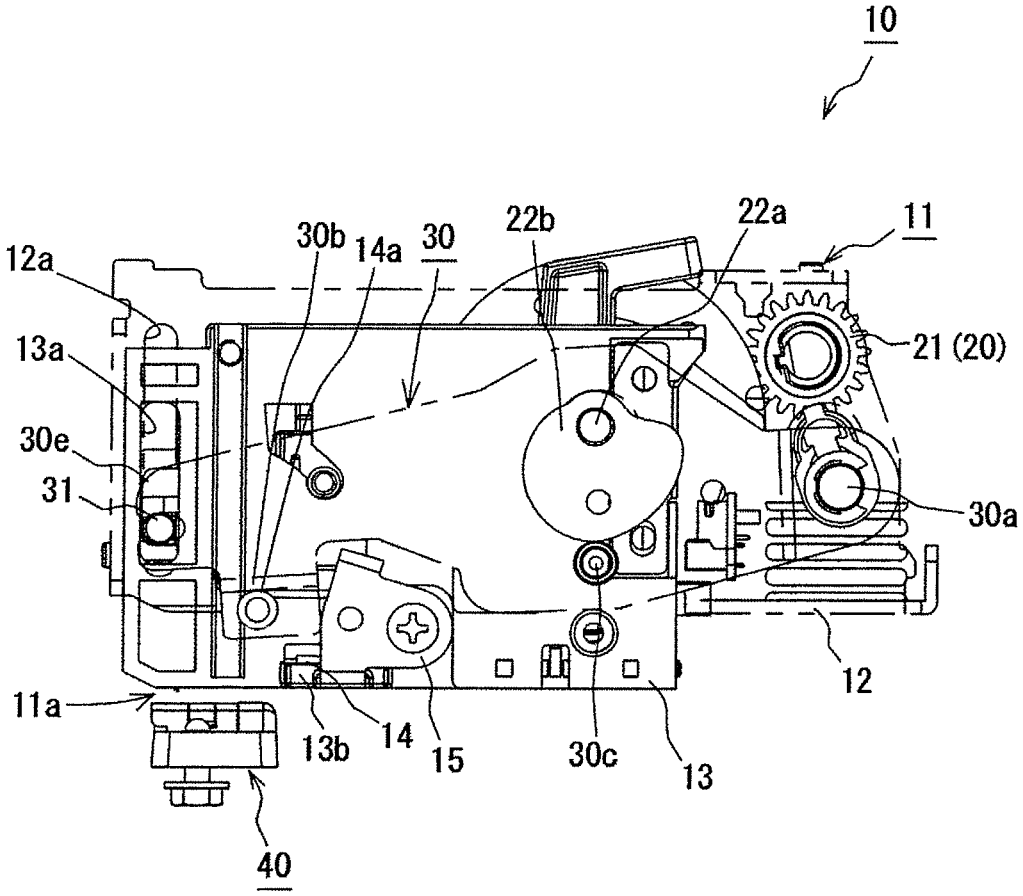
FIG. 8 is an explanatory view showing an operation of the electric stapler, showing a state where the clamp part is lowered.

When the motor is further driven from the position shown in FIG. 7 and thus the gear mechanism 20 is activated, a state as shown in FIG. 8 is obtained. This state refers to a state where the clamp part 13 is lowered and is most accessible to the clincher mechanism 40. In fact, the state refers to a state where the sheets are clamped between the clamp part 13 and the clincher mechanism 10. For convenience of explanation, the sheets are omitted in the drawings.

In this state, the distance from the peripheral edge of the lower end of the cam 22*b* to the shaft 22*a* of the cam 22*b* is the longest. That is, the link member 30 is maximally pressed down by the cam 22*b*. Thereby, the link member 30 is located at the lowermost position.

At this time, the shaft 31 supported by the shaft holding part 30*d* of the link member 30 is also located at the uppermost position. Therefore, the driver member 16 and the forming plate 17 which are held by the shaft 31 are also moved to the lowermost position (in the driving direction) and thus forming or driving of the staple is performed and completed.

Further, since the biasing engagement part 30*b* of the link member 30 is engaged with the upper end 14*a* of the clamp spring 14 and the link member 30 is located at the lowermost position, a push-down load of the clamp part 13 by the clamp spring 14 also becomes the maximum. That is, the clamp part 13 is maximally pressed down toward the clincher mechanism 40 and thus the sheets are most strongly clamped therebetween.

At this time, the difference in thickness of the sheets is absorbed by the deflection of the clamp spring 14. For example, FIG. 8 shows the position of the clamp part 13 in a case where the number of the sheets is twenty sheets. When the number of the sheets is less than twenty sheets, the clamp part 13 moves further down. When the number of the sheets is more than twenty sheets, the clamp part 13 is stopped at a more upward position.

With such a configuration, the clamp part 13 clamps the sheets in cooperation with the clincher mechanism 40 and thus it is possible to absorb the difference in paper thickness by the deflection of the clamp spring 14.

Figure 9:
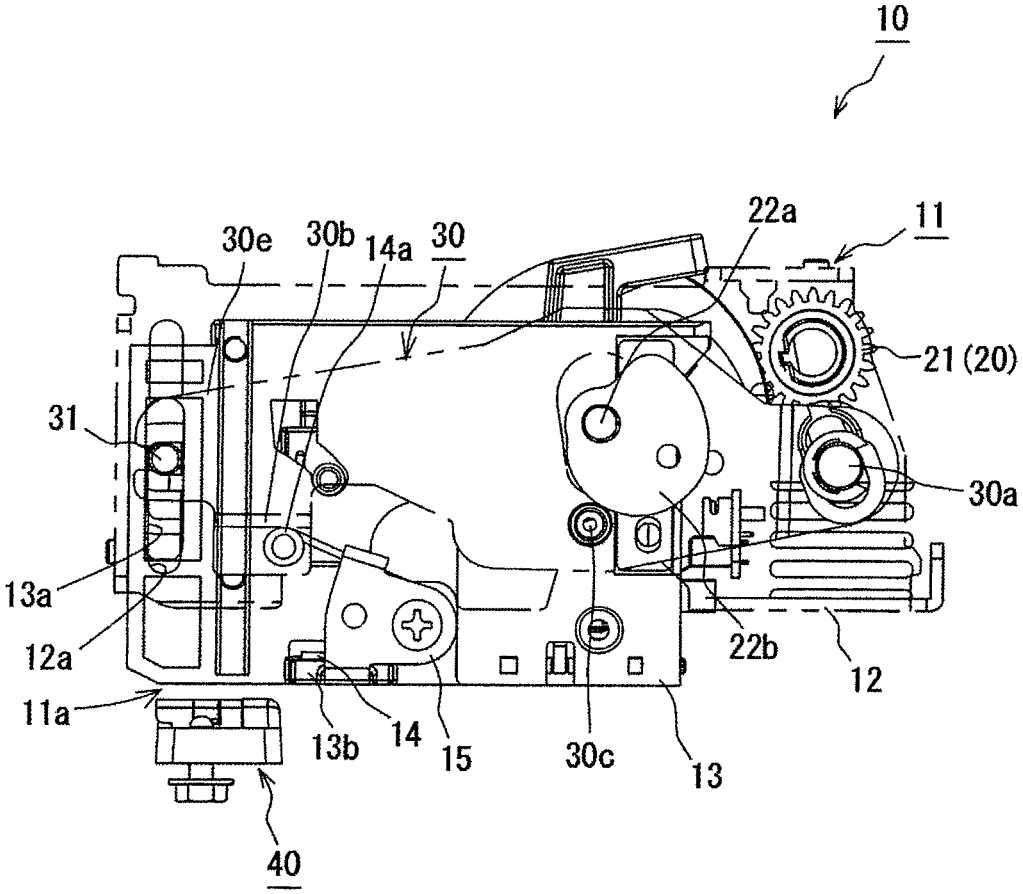
FIG. 9 is an explanatory view showing an operation of the electric stapler, showing a state where the clamp part begins to ascend.

When the motor is further driven from the position shown in FIG. 8 and thus the gear mechanism 20 is activated, the link member 30 is swung in a direction opposite to the driving direction and thus the leading end 30*e* of the link member 30 begins to rise, as shown in FIG. 9. When the leading end 30*e* of the link member 30 rises to a predetermined position, the shaft 31 is engaged with the sliding hole 13*a* of the clamp part 13 to lift the clamp part 13 toward the home position. That is, the clamp part 13 is moved in a direction away from the clincher mechanism 40. And then, as the motor is further driven and thus the gear mechanism 20 is activated, the link member 30 is moved to the home position shown in FIG. 5 while biasing the clamp part 13. The gear mechanism 20 is stopped at the home position and then a stand-by state is continued until next sheets into which the staples are driven are ready.

Since the biasing engagement part 30*b* of the link member 30 is not engaged with the clamp spring 14 in the stand-by state (in a state where the clamp part 13 is in the home position), as mentioned above, the biasing force of the clamp spring 14 is not applied to the clamp part 13.

(Summary)

In accordance with the above embodiments, the clamp part 13 is released from the biasing of the clamp spring 14 as the biasing mechanism at least when the clamp part 13 is in the home position where the clamp part 13 is most spaced apart from the clincher mechanism 40, the load of the clamp spring 14 is not applied to the clamp part 13 at the stand-by state where the driving of the staple is not performed. Accordingly, the biasing on the clamp part 13 can be restricted in such a way the clamp part 13 is not always subjected to the biasing and thus it is possible to reduce the slant of the clamp part 13.

Further, the link member 30 includes the biasing engagement part 30*b* engageable with the clamp spring 14 and the biasing engagement part 30*b* is engaged with the clamp spring 14 to allow the clamp spring 14 to be operated when the link member 30 is swung to a predetermined position in a driving direction. In this way, the clamp spring 14 can be operated in conjunction with the driving operation by the motor and thus it is possible to apply a biasing force for clamping only immediately before the staple is driven (when the driver member 16 is driven to a predetermined position in the driving direction).

Further, the link member 30 includes the shaft 31 as the clamp engagement part which is engaged with the clamp part 13 and the shaft 31 is engaged the clamp part 13 and moves while pushing the clamp part 13 in a position of the home position when the link member 30 is swung to a predetermined position in a direction opposite to the driving direction. In this way, it is possible to move the clamp part 13 to the home position in conjunction with the driving operation by the motor.

Further, the clamp part 13 is movably supporting the detecting piece 32 for detecting the presence or absence of the connected staples "A" and the main body 12 includes the sensor 35 which senses a state of the detecting piece 32 and outputs a signal in accordance with the presence or absence of the connected staples "A". In this way, since the sensor 35 is not provided to the movable clamp part 13, it is not necessary to use a configuration such as a flexible cable which is required for the movement of the clamp part 13 and thus the electric stapler can be made at a low cost. Furthermore, since the slant of the clamp part 13 can be prevented, it is also possible to avoid the problem that the position of the detecting piece 32 provided to the clamp part 13 is deviated and thus the detection of the presence or absence of staples A does not work properly.

In accordance with the above embodiments, an electric stapler 10 may include: a driver mechanism 11 including a driver member 16 for driving a staple into sheets in a driving direction; and a clincher mechanism 40 provided to face the driver mechanism 11 and for bending legs of the staple driven and penetrating through the sheets along a back side of the sheets. The driver mechanism 11 may include: a main body 12; a clamp part 13 slidably accommodated in the main body 12 and movable toward or away from the clincher mechanism 40 so as to clamp the sheets in cooperation with the clincher mechanism 40; and a biasing mechanism 14 for urging the clamp part 13 toward the sheets. The biasing mechanism 14 does not urge the clamp part 13 at least when the clamp part 13 is in a home position where the clamp part 13 is the most remote from the clincher mechanism 40.

The driver member 16 is movable with respect to the main body 12 in the driving direction. The clamp part 13 is movable with respect to the main body 12 in the driving direction. The driver member 16 is movable with respect to the clamp part 13 in the driving direction.

According to this structure, since the clamp part is does not engage with the biasing mechanism at least when the clamp part is in the home position where the clamp part is most apart from the clincher mechanism, the load of the biasing mechanism is not applied to the clamp part at a stand-by state where the driving of the staple is not performed. Accordingly, the biasing on the clamp part can be restricted in such a way the clamp part is not always subjected to the biasing and thus it is possible to reduce the slant of the clamp part.

In the above structure, the driver mechanism 11 may include: a gear mechanism 20 driven by a drive source; and a link member 30 swung by a cam 22*b* included in the gear mechanism 20. The driver member 16 may be driven by the link member 30. The link member 30 may include a biasing engagement part 30*b* which is engageable with the biasing mechanism 14. The biasing engagement part 30*b* may engage with the biasing mechanism 14 to allow the biasing mechanism 14 to urge the clamp part 13 when the link member 30 is swung to a predetermined position in the driving direction.

According to this structure, the link member includes the biasing engagement part engageable with the biasing mechanism and the biasing engagement part engages with the biasing mechanism to allow the biasing mechanism to work when the link member is swung to the predetermined position in the driving direction. Thus, the biasing mechanism can be operated in conjunction with a driving operation by a motor and thus it is possible to apply an urging force for clamping only immediately before the staple is driven (when the driver member moves to the predetermined position in the driving direction).

In the above structure, the driver mechanism 11 may include: a gear mechanism 20 driven by a drive source; and a link member 30 swung by a cam 22*b* included in the gear mechanism 20. The driver member 16 may be driven by the link member 30. The link member 30 may include a clamp engagement part 31 which engages with the clamp part 13. The clamp engagement part 31 may engage with the clamp part 13 to push the clamp part 13 toward the home position when the link member 30 is swung to a predetermined position in a direction opposite to the driving direction.

According to this structure, the link member includes the clamp engagement part which engages with the clamp part and the clamp engagement part engages with the clamp part and moves while pushing the clamp part toward the home position when the link member is swung to a predetermined position in a direction opposite to the driving direction. Thereby, it is possible to move the clamp part to the home position in conjunction with the driving operation by the motor.

In the above structure, the clamp part may movably support a detecting piece 32 that detects connected staples. The main body 12 may include a sensor 35 that senses a state of the detecting piece 32 and outputs a signal in accordance with a presence or absence of the connected staples.

According to this structure, the clamp part is movably supporting the detecting piece for detecting the presence or absence of the connected staples and the main body includes a sensor which senses a state of the detecting piece and outputs a signal in accordance with the presence or absence of the connected staples. In this way, since the sensor is not provided to the movable clamp part, it is not necessary to use a configuration such as a flexible cable which is required for the movement of the clamp part and thus the electric stapler can be made at a low cost. Furthermore, since the slant of the clamp part can be prevented, it is also possible to avoid the problem that the position of the detecting piece provided to the clamp part is deviated and thus the detection of the presence or absence of staples does not work properly.

What is claimed is:

1. An electric stapler comprising:

a driver mechanism including a driver member, wherein a staple is driven into sheets by the driver member in a driving direction; and a clincher mechanism provided to face the driver mechanism, wherein legs of the staple driven and penetrating through the sheets are bent along a back side of the sheets by the clincher mechanism, wherein the driver mechanism further includes:

a main body;

a clamp part slidably accommodated in the main body, wherein the clamp part is movable toward or away from the clincher mechanism so as to clamp the sheets in cooperation with the clincher mechanism; and a biasing mechanism that urges the clamp part toward the sheets, and wherein the biasing mechanism is out of operation of urging the clamp part at least when the clamp part is in a home position where the clamp part is the most remote from the clincher mechanism.

2. The electric stapler according to claim 1, wherein the driver mechanism further includes:

a gear mechanism driven by a drive source; and a link member swung by a cam included in the gear mechanism, wherein the driver member is driven by the link member, wherein the link member includes a biasing engagement part engageable with the biasing mechanism, and wherein the biasing engagement part engages with the biasing mechanism to allow the biasing mechanism to urge the clamp part when the link member is swung to a predetermined position in the driving direction.

3. The electric stapler according to claim 1, wherein the driver mechanism further includes:

a gear mechanism driven by a drive source; and a link member swung by a cam included in the gear mechanism, wherein the driver member is driven by the link member, wherein the link member includes a clamp engagement part which engages with the clamp part, and wherein the clamp engagement part engages with the clamp part to push the clamp part toward the home position when the link member is swung to a predetermined position in a direction opposite to the driving direction.

4. The electric stapler according to claim 1, wherein the clamp part movably supports a detecting piece that detects connected staples, and wherein the main body includes a sensor that senses a state of the detecting piece and outputs a signal in accordance with a presence or absence of the connected staples.

5. The electric stapler according to claim 1, wherein the driver member is movable with respect to the main body in the driving direction, wherein the clamp part is movable with respect to the main body in the driving direction, and wherein the driver member is movable with respect to the clamp part in the driving direction.

6. An electric stapler comprising:

a driver mechanism including a driver member, wherein a staple is driven into sheets by the driver member in a driving direction; and a clincher mechanism provided to face the driver mechanism, wherein legs of the staple driven and penetrating through the sheets are bent along a back side of the sheets by the clincher mechanism, wherein the driver mechanism further includes:

a main body;

a clamp part slidably accommodated in the main body, wherein the clamp part is movable toward or away from the clincher mechanism so as to clamp the sheets in cooperation with the clincher mechanism;

a biasing mechanism that urges the clamp part toward the sheet;

wherein the driver mechanism further includes:

a gear mechanism driven by a drive source;

a link member swung by a cam included in the gear mechanism, wherein the driver member is driven by the link member, wherein the link member includes a biasing engagement part engageable with the biasing mechanism, wherein the biasing engagement part engages with the biasing mechanism to allow the biasing mechanism to urge the clamp part when the link member is swung to a predetermined position in the driving direction, wherein the link member includes a clamp engagement part engageable with the clamp part, and wherein the clamp engagement part engages with the clamp part to push the clamp part toward the home position when the link member is swung to a predetermined position in a direction opposite to the driving direction, wherein, when the link member is located at the uppermost position, the clamp part is in the home position, where the clamp part is the most remote from the clincher mechanism, and the biasing engagement part is located at a position higher than an upper end of the biasing mechanism, wherein the biasing engagement part is not engaged with the biasing mechanism, and wherein the biasing mechanism is out of operation of urging the clamp part, wherein, when the link member is moved downward in the driving direction, the clamp engagement part lifting the clamp is moved downward, the engagement of the clamp engagement part and the clamp part is released and thus the clamp part is slidable downward by the movement amount of the clamp engagement part.

7. The electric stapler according to claim 6, wherein the clamp part movably supports a detecting piece that detects connected staples, and wherein the main body includes a sensor that senses a state of the detecting piece and outputs a signal in accordance with a presence or absence of the connected staples.

8. The electric stapler according to claim 6, wherein the driver member is movable with respect to the main body in the driving direction, wherein the clamp part is movable with respect to the main body in the driving direction, and wherein the driver member is movable with respect to the clamp part in the driving direction.

* * * * *